US008162504B2

(12) United States Patent
Zhang et al.

(10) Patent No.: US 8,162,504 B2
(45) Date of Patent: Apr. 24, 2012

(54) REFLECTOR AND SYSTEM

(75) Inventors: Tong Zhang, Oxon (GB); David Montgomery, Oxfordshire (GB)

(73) Assignee: Sharp Kabushiki Kaisha, Osaka (JP)

( * ) Notice: Subject to any disclaimer, the term of this patent is extended or adjusted under 35 U.S.C. 154(b) by 321 days.

(21) Appl. No.: 12/423,898

(22) Filed: Apr. 15, 2009

(65) Prior Publication Data

US 2010/0265720 A1 Oct. 21, 2010

(51) Int. Cl.
*F21V 7/04* (2006.01)
*F21V 5/00* (2006.01)

(52) U.S. Cl. ..... 362/217.05; 362/217.06; 362/217.07; 362/217.02; 362/296.01; 362/299; 362/341; 362/347

(58) Field of Classification Search ..... 362/222–224, 362/217.02–217.09, 297–309, 326–327, 362/335–338, 311.01, 296.01, 296.05–296.08, 362/341, 347
See application file for complete search history.

(56) References Cited

U.S. PATENT DOCUMENTS 3,775,605 A * 11/1973 Rijnders ..... 362/217.12
4,460,942 A * 7/1984 Pizzuti et al. ..... 362/16
6,161,946 A 12/2000 Bishop et al.
6,760,157 B1 7/2004 Allen et al.
6,923,554 B2 * 8/2005 Kuo ..... 362/223
7,587,117 B2 * 9/2009 Winston et al. ..... 385/146
2011/0013387 A1 * 1/2011 Kanade et al. ..... 362/224

FOREIGN PATENT DOCUMENTS

| | | | |
|---|---|---|---|
| EP | 228288 | A2 * | 7/1987 |
| GB | 2 173 889 | A | 10/1986 |
| JP | 57-162201 | A | 10/1982 |
| JP | 59-3417 | U | 1/1984 |
| JP | 61-277102 | A | 12/1986 |
| JP | 02-288004 | A | 11/1990 |
| JP | 3140639 | U | 3/2008 |

OTHER PUBLICATIONS

Office Action for corresponding Japanese Application No. 2010-085332 mailed Oct. 18, 2011.

* cited by examiner

*Primary Examiner* — Robert May
(74) *Attorney, Agent, or Firm* — Renner, Otto, Boisselle & Sklar, LLP

(57) ABSTRACT

An illumination system includes a light source and a reflector. The reflector includes a first optical interface adjacent the light source which redirects light emitted from the light source and incident on the first optical interface via Fresnel reflection. In addition, the reflector includes a second optical interface adjacent the first optical interface on a side opposite the light source, which reflects light passing through the first optical interface via total internal reflection back towards the first optical interface. Also, a light collection system includes such a reflector.

19 Claims, 12 Drawing Sheets

REFLECTOR AND SYSTEM

TECHNICAL FIELD

The present invention relates to a reflector design for illumination systems. Such systems can include backlighting systems, general lighting systems, and systems in other particular fields like automotive headlamp design.

BACKGROUND OF THE INVENTION

FIG. 1 of the accompanying drawings illustrates the general design of a linear reflector 12 based on a linear light source 11, which is widely used in general lighting, automotive headlamps, etc. The linear reflector 12 is parabolic in its cross section. The linear light source 11 is located at the focal point of the parabolic shaped linear reflector 12. The light source 11 emits light in all directions. When the light is reflected by the parabolic reflector 12 it is collimated in the z-y plane. The light, however, is still uncontrolled regarding beam shaping in the z-x plane. The angular distribution of the output light measured by a detector plane 13 is shown in FIG. 1(*b*).

On the other hand, in order to increase the light output, the reflectance of the reflector 12 needs to be as high as possible, or the light loss on the reflector 12 needs to be minimized. In order to do so, higher cost is normally associated which becomes an issue and a hundred percent reflectance is still impossible.

U.S. Pat. No. 6,760,157 B1 (R. C. Allen) describes a design for a brightness enhancement film (BEF) available from 3M. Using the microstructure suggested in this patent as represented in FIG. 2, light 22 with a wide emitting angle can be compressed close to a normal angle. At the same time, light 25 emitting with a normal angle will be reflected by total internal reflection (TIR) within the film 21 and then recycled 24 inside the system by diffuser sheet or reflector 23 below it. As a result, with one BEF the angular distribution of the output light is improved which means the peak brightness is increased in one direction (for example, left and right). With another BEF that has its elongate structure perpendicular to the previous BEF the light output angular performance can be further improved in the other direction (for example, back to front). The BEFs are used widely in backlighting systems especially with liquid crystal display (LCD) systems because LCD panels perform better when the light passes therethrough close to the normal incident angle.

U.S. Pat. No. 6,161,946 (C. B. Bishop) describes a reflector design for a lamp as represented in FIG. 3. The reflector consists of an elliptical reflector 35 and a spherical reflector 32 to get the best focused beam. In this design, the light source 31 is located on one of the focal points of the elliptical reflector 35; therefore the light coming from the source and being reflected by the elliptical reflector 35 will be focused to the conjugate focal point. Light traveling directly away from the elliptical reflector 35 will be reflected by the spherical reflector 32. Because the location of the light source 31 is also the central point of the spherical reflector 32, the light hitting the spherical reflector 32 will be reflected back to exactly the same path then get reflected again by the elliptical reflector 35 and focused on the same conjugate focal point. Therefore, the best focused beam is obtained. There are three main limits in the design. The first two relate to the reflector coating process and performance. Higher reflectance normally means higher cost with respect to the coated material and process. which This results in a cost issue. Also, light loss which takes place on the reflector is generally around 5-10% and will cause thermal issues as well. The third limit is that this circular type reflector design does not work well with the linear type light source.

SUMMARY OF THE INVENTION

The present invention is based on two physical phenomena: Fresnel reflection and total internal reflection (TIR). When light moves between two mediums with different refractive indices (referred to herein as an "optical interface"), reflection of the light will take place. For the mediums of glass/air or plastic/air, the reflection ratio is about 4%. However, when a ray of light in a higher refractive index medium strikes a medium boundary at an angle larger than the critical angle with respect to the normal to the surface, total internal reflection will take place. This means no light can pass through, so effectively all of the light is reflected with no loss. The critical angle is the angle of incidence above which the TIR occurs that depends on the difference between the two refractive indices.

Having considered above two physical phenomena, it becomes possible to design a reflector that theoretically has no light loss even without an expensive metal reflector coating. Below we will explain a few exemplary reflector designs through the embodiments. One of the embodiments also has the function of beam shaping.

In accordance with an aspect of the invention, an illumination system is provided which includes a light source and a reflector. The reflector includes a first optical interface adjacent the light source which redirects light emitted from the light source and incident on the first optical interface via Fresnel reflection. In addition, the reflector includes a second optical interface adjacent the first optical interface on a side opposite the light source, which reflects light passing through the first optical interface via total internal reflection back towards the first optical interface.

According to a particular aspect, the reflector includes an optically transparent material having a flat surface on one side which forms a part of the first optical interface, and a surface having a prism structure on an opposite side forming a part of the second optical interface.

According to another aspect, the prism structure includes grooves on the surface of the material According to yet another aspect, the reflector is shaped to compress the light reflected via Fresnel reflection generally in a first plane, and the prism structure is arranged to compress the light reflected via total internal reflection generally in a second plane orthogonal to the first plane.

In accordance with another aspect, the reflector compresses the light reflected via Fresnel reflection generally in a first plane, and compresses light which passes through the second optical interface without being totally internally reflected in generally a second plane orthogonal to the first plane.

In accordance with still another aspect, the reflector is shaped in relation to a focal point, and the light source is located proximate the focal point.

According to yet another aspect, the light source is a linear light source and the reflector runs parallel the linear light source.

With still another aspect, the second optical interface includes parallel grooves which run in a direction orthogonal to an axis of the linear light source.

According to another aspect, the reflector is a circular reflector.

In accordance with another aspect, the circular reflector has a generally elliptical, circular or parabolic cross section about a z-axis and the second optical interface includes grooves which vary in pitch along the z-axis.

In yet another aspect, the reflector includes a pyramid type reflector at a point at which the grooves are convergent upon one another.

According to another aspect, the illumination system includes an outer reflector adjacent the reflector on a side opposite the light source which reflects light which was incident on the second optical interface but not totally internally reflected.

With respect to another aspect, the outer reflector is coated with a highly reflective material.

In yet another aspect, the outer reflector includes a third optical interface adjacent the reflector which redirects light passing through the reflector via Fresnel reflection; and a fourth optical interface adjacent the third optical interface on a side opposite the reflector, which reflects light passing through the third optical interface via total internal reflection back towards the third optical interface.

According to another aspect, the reflector and outer reflector are each elliptical, circular or parabolic in cross section and share a same focal point where the light source is located.

According to another aspect, the reflector and outer reflector are each elliptical, circular or parabolic in cross section and have different respective focal points proximate where the light source is located.

In accordance with yet another aspect, the second optical interface diffracts the light which was not totally internally reflected towards an angle near normal to the outer reflector.

According to still another aspect, the reflector is made only of optically transparent material.

According to another aspect, the material is at least one of a glass material or a plastic material In accordance with another aspect, the first optical interface and second optical interface each comprise an air/substrate interface.

In yet another aspect, the prism structure includes grooves having at least one varying alignment, pitch, top angle or top angle orientation.

According to another aspect, the second optical interface includes parallel grooves which run in a direction parallel to an axis of the linear light source.

According to another aspect, an illumination system is provided which includes a plurality of illumination systems each representing a unit arranged in an array.

In accordance with another aspect, a light collection system is provided. The system includes a light receiving element and a reflector. The reflector includes a first optical interface adjacent the light receiving element which redirects light incident on the first optical interface via Fresnel reflection towards the light receiving element; and a second optical interface adjacent the first optical interface on a side opposite the light receiving element, which reflects light passing through the first optical interface via total internal reflection back towards the first optical interface.

According to another aspect, the reflector includes an optically transparent material having a flat surface on one side which forms a part of the first optical interface, and a surface having a prism structure on an opposite side forming a part of the second optical interface.

According to still another aspect, the prism structure includes grooves on the surface of the material According to another aspect, the reflector is shaped to compress the light reflected via Fresnel reflection generally in a first plane, and the prism structure is arranged to compress the light reflected via total internal reflection generally in a second plane orthogonal to the first plane.

In accordance with another aspect, the reflector compresses the light reflected via Fresnel reflection generally in a first plane, and compresses light which passes through the second optical interface without being totally internally reflected in generally a second plane orthogonal to the first plane.

According to another aspect, the reflector is shaped in relation to a focal point, and the light receiving element is located proximate the focal point.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1A:
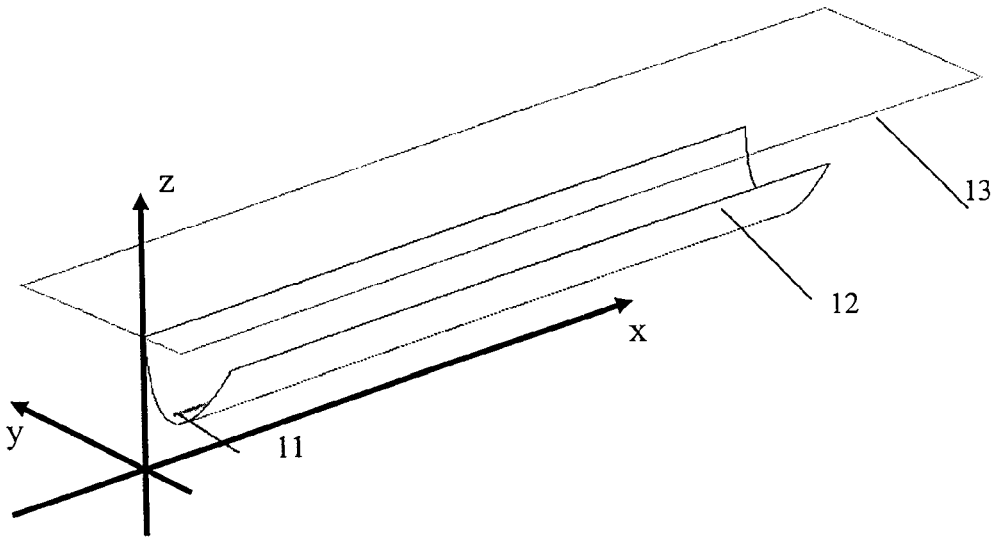
Fig. 1(a) Conventional Art
FIGS. 1(*a*) and 1(*b*) illustrate a typical reflector design for a linear light source and its performance, respectively.

The present invention will now be described in detail with reference to the drawings, in which like reference numerals are used to refer to like elements throughout.

Figure 4A:
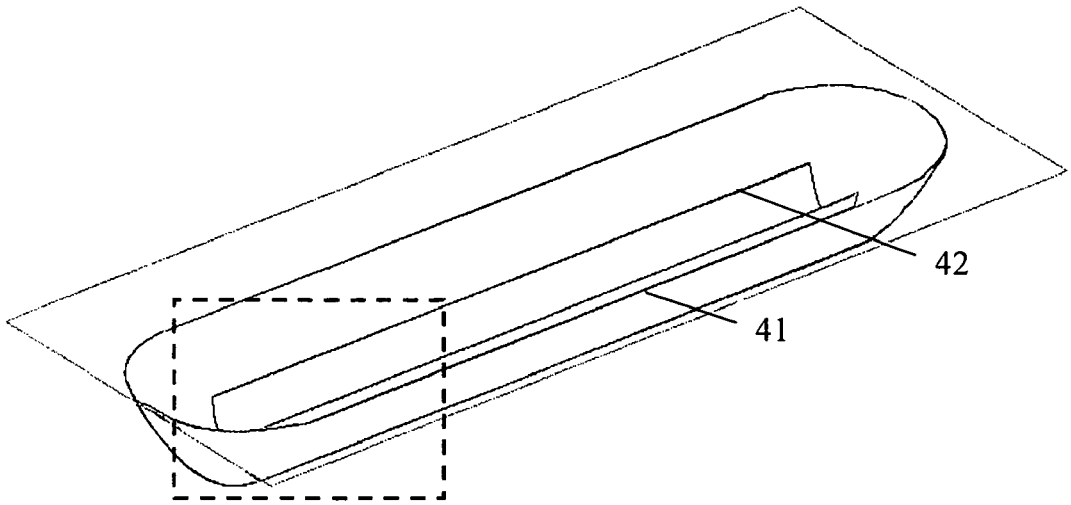
FIGS. 4(*a*)-4(*c*) illustrate a linear light source reflector and a principle of operation thereof in accordance with a first embodiment of the present invention.
Figure 4B:
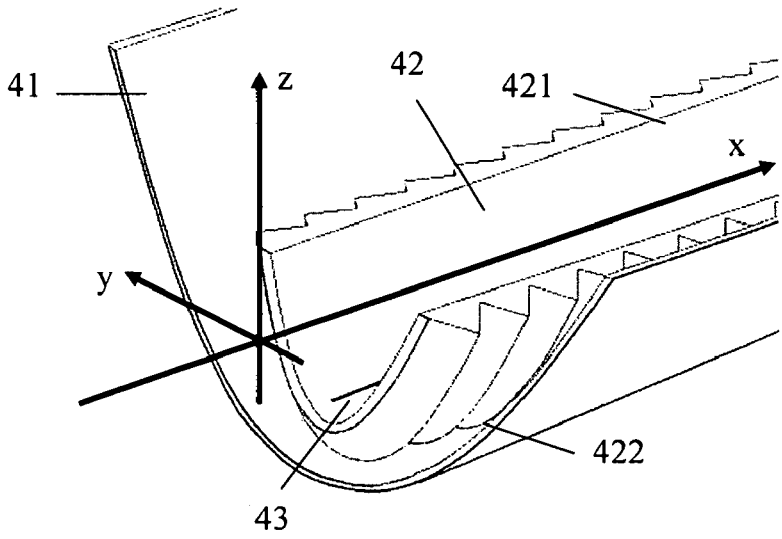
Figure 4C:
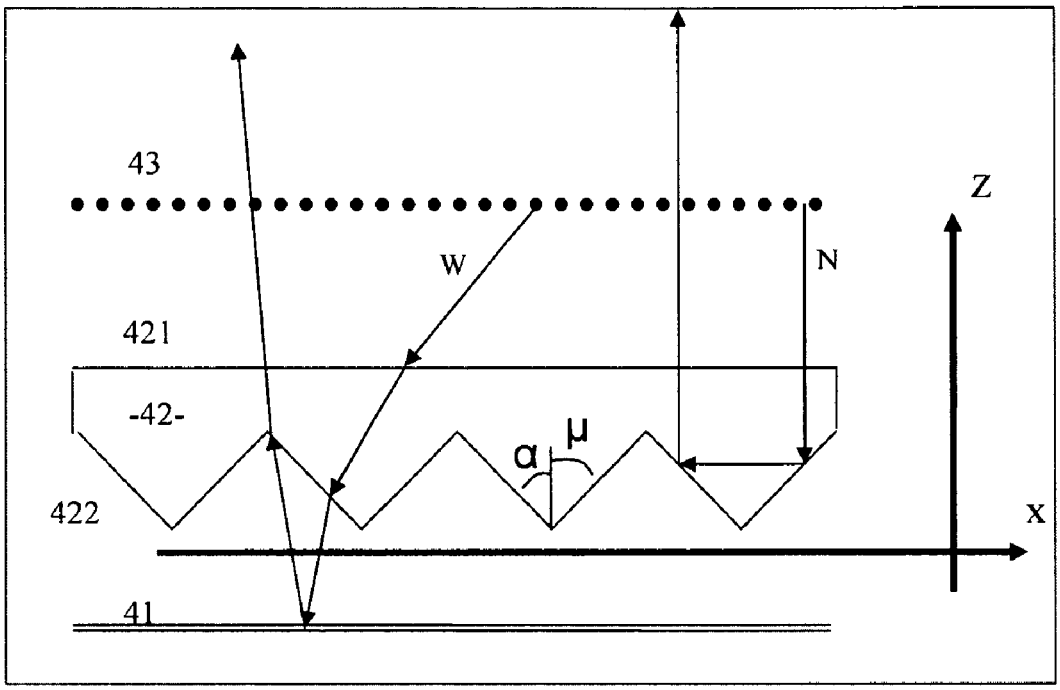

FIG. 4(*a*) shows a first embodiment of a linear light source reflector design in accordance with the present invention. FIG. 4(*b*) is an enlarged view of the left end of the reflector represented in dotted line in FIG. 4(*a*). In this design, there are two linear parabolic reflectors which are referred to herein as an inner reflector 42 and outer reflector 41. The outer reflector 41 is coated with high reflective material like metal. The inner reflector 42 does not have any high reflectance surface coating and is made from transparent material only such as poly (methyl methacrylate) (PMMA), polycarbonate (PC), etc. These two parabolic reflectors share the same focal point where a linear light source 43 is located. Because of the parabolic shape, for the light emitted from the linear light source 43 when it is reflected by the inner reflector 42, the light will be collimated in z-y plane; any light which may pass through the inner reflector 42 will hit the outer reflector 41, and thus the light will still be collimated in z-y plane.

The inner reflector 42 has an inner surface 421 which is facing the linear light source 43, and an outer surface 422 which has a micro prism structure that has top angle of about 90 degrees. The linear light source 43 is considered to be an isotropic light source that emits light in all directions like the case in FIG. 1. FIG. 4(*c*) represents a cross section of FIG. 4(*b*) in the z-x plane. The dashed line indicates the linear light source 43. The inner reflector 42 with its outer surface prism structure 422 and the outer reflector 41 (represented by a doubled line) are shown under the light source 43 respectively.

When the light from the light source 43 reaches the inner reflector 42, Fresnel reflection occurs on the flat inner surface 421 of the inner reflector 42. The rest of the light will keep traveling toward the surface 422 with the micro prism structure. For light traveling at a wide angle (W), it will be diffracted by the prism surface 422 to a near normal angle to the outer reflector 41 in the z-x plane. Thus, the prism structure tends to compress or collimate the light traveling at wide angles (W) in the z-x plane. Thereafter, the light is reflected and then collimated in the z-y plane by the outer reflector 41. For the light traveling with close to normal angle (N), after the Fresnel reflection on the surface 421 TIR will take place on the prism surface 422 with no light loss, and again get collimated by the inner reflector 41 because the prism surface is also part of the parabolic surface as described before.

Figure 1B:
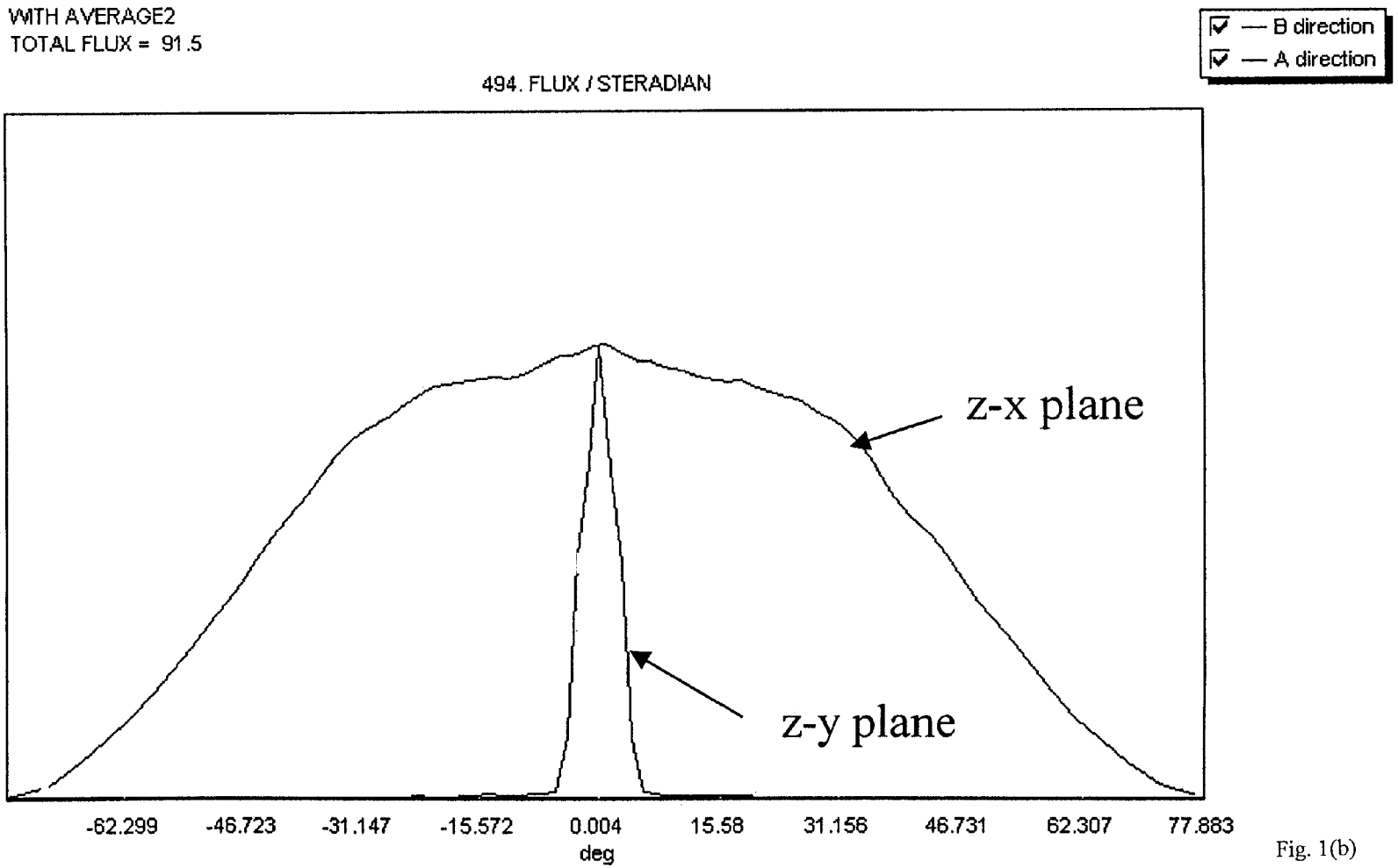
Fig. 1(b) Conventional Art
Figure 2:
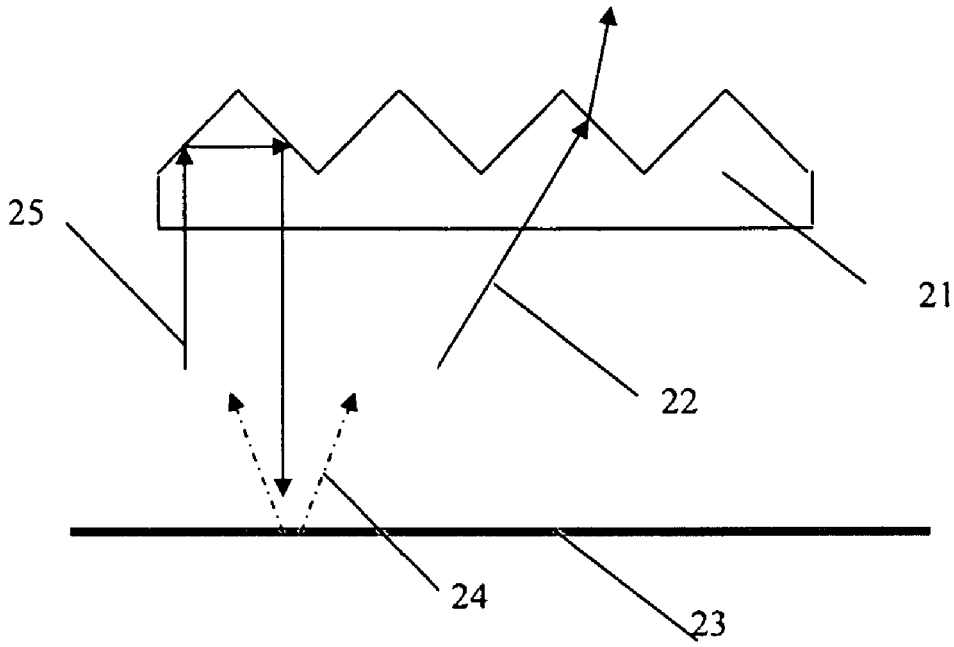
CONVENTIONAL ART Fig. 2
FIG. 2 illustrates the principle of a conventional brightness enhancement film.
Figure 3:
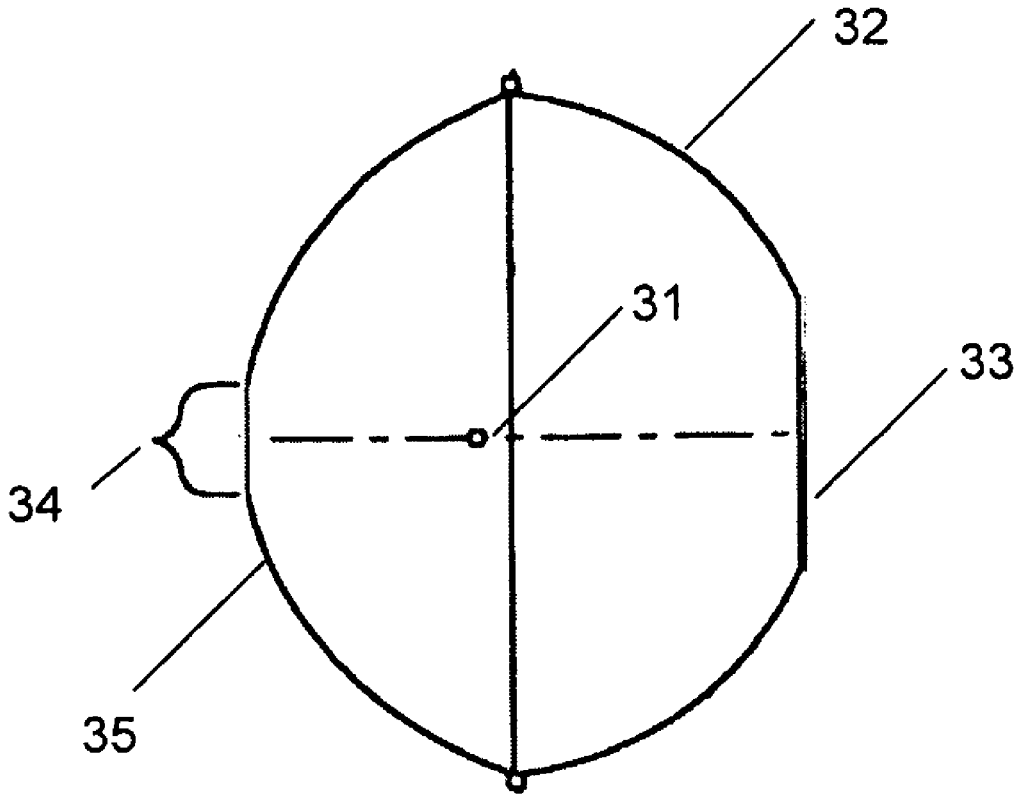
CONVENTIONAL ART Fig. 3
FIG. 3 illustrates a conventional design that utilizes an elliptical reflector and a spherical reflector.
Figure 5:
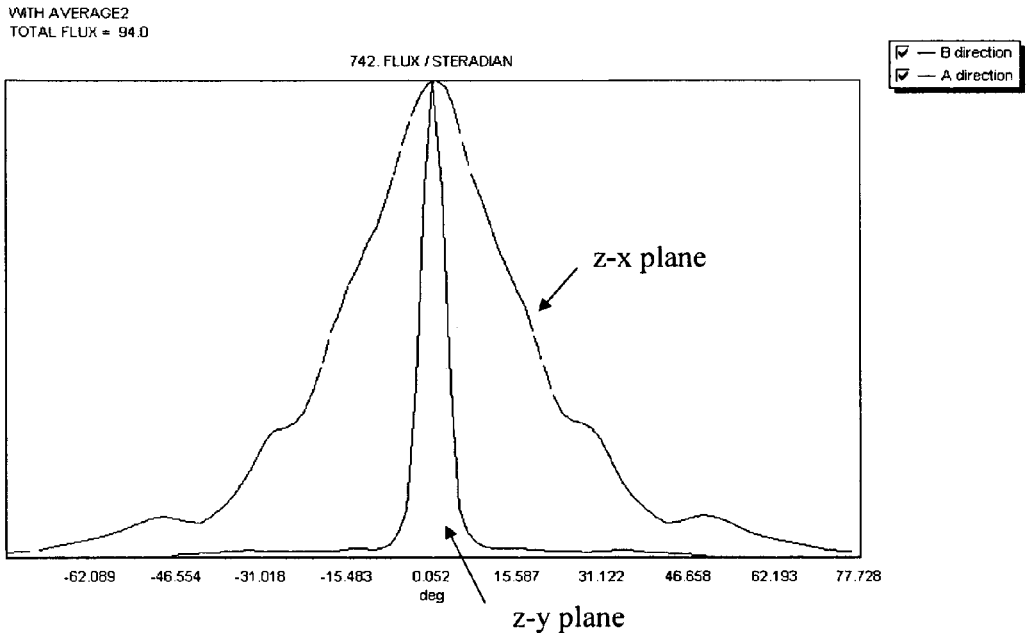
FIG. 5 illustrates the simulation results of the performance of the first embodiment.

The simulation results of the angular performance of the output light are shown in FIG. 5 which is in the same scale with FIG. 1(*b*) for the comparison with the system without the inner reflector 42. FIG. 5 shows that not only the angular performance is improved, but also the peak brightness is increased by about 50%. In addition, the light reflected by the inner reflector 42 has extremely low loss even though it has no coating because it is made from transparent material. Although part of the light passing through the inner reflector 42 is still reflected by the outer reflector 41 that has certain light loss, the overall light loss of this design can be reduced by about 30% compared to the design shown in FIG. 1.

The cross section of the linear reflectors (in z-y plane) in this embodiment does not have to be parabolic shape, it can also be other shapes such as elliptical or circular depending, for example, on the target of beam shaping. The function of the prism structured inner reflector 42, however, remains the same which is to improve the angular distribution further and reduce the light loss by utilizing TIR.

The top angle of the prism structure can also vary depends on the target for the beam shaping, as well as the angle of $\alpha$ and $\mu$.

In addition to this embodiment, the focal points of inner reflector 42 and outer reflector 41 can located at different positions for different beam controlling effects which means these two reflectors will reflect the light with different angular distribution. The prism structure on the inner reflector 42, however, remains in order to compress the light in z-x plane.

Figure 6:
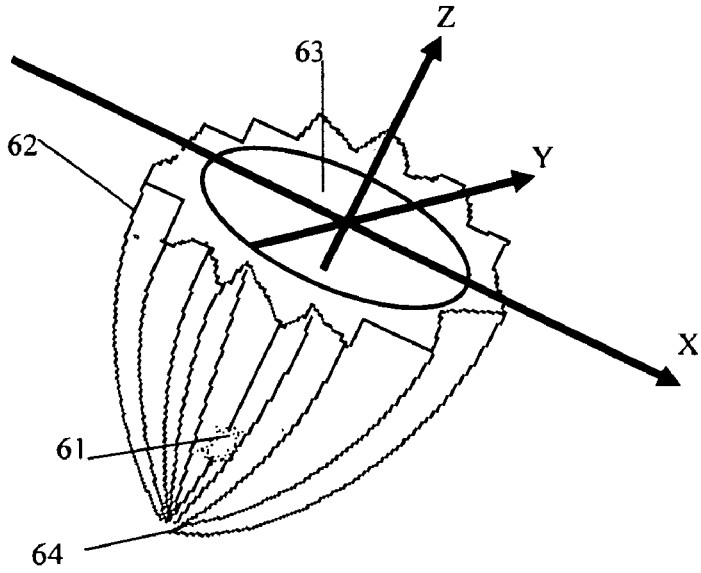
FIG. 6 illustrates a circular light source reflector in accordance with a second embodiment of the present invention.

A second embodiment is shown in FIG. 6. This embodiment shows a design of coating-less circular reflector. The cross section of the inner surface 63 of the reflector on Z-X plane can be elliptical, parabolic or other required shapes. The outer surface 62 of the reflector has the same shape, it, however, is structured with micro prisms of which the pitch varies along the Z-axis. The top angle of the prism is about 90 degree therefore the light coming from light source 61 located at a focal point within the reflector will experience TIR when it is reflected by prism surface 62. Like the situation described above, Fresnel reflection also takes place on the inner flat surface 63. Because the top angle of the prism is maintained about 90 degree, the pitch of the prism gets smaller and smaller towards the far end point 64 of the reflector. There can be an extra reflector that surrounds the prism surface to recycle the leaking light. The optional extra reflector is not shown in the figure.

At the far end point 64 of the reflector (the shaper head), when the prism pitch gets to the order of micrometer it becomes more difficult to manufacture. As a particular solution shown in FIG. 7(*a*), there is a three sided pyramid shape reflector that has the angles formed by lines OA and OB, OB and OC, OC and OA all about 90 degrees. For the light coming parallel to the axis Z TIR will again occur on the surfaces around the pyramid shape reflector which is shown with the arrow marks. Therefore, no light loss takes place during the reflection. Moreover, such structures is easier to make compared to the small pitch prism structure at the far end point 64.

Figure 7A:
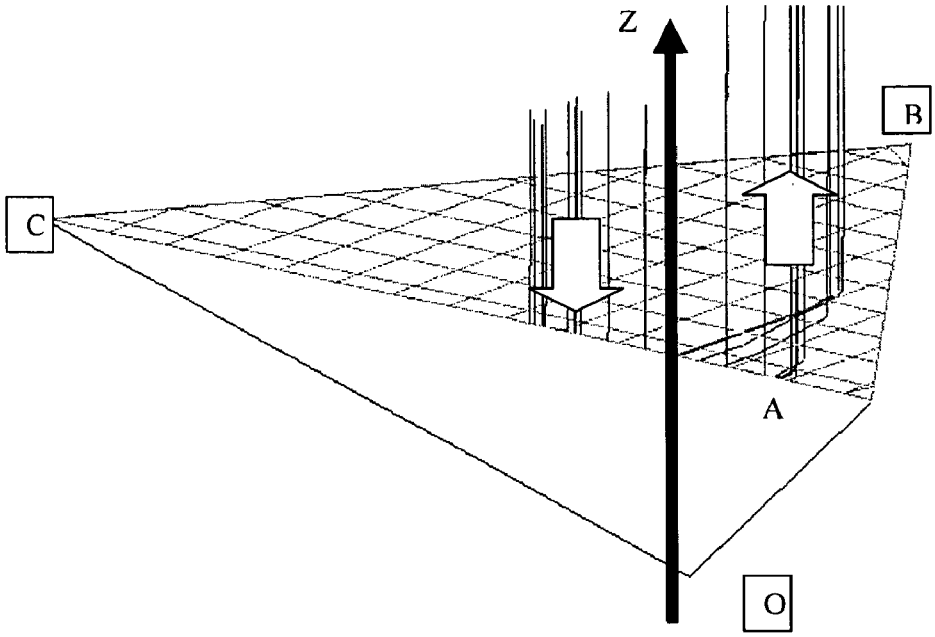
FIGS. 7(*a*) and 7(*b*) illustrate respective far-end point micro-reflector designs to reflect light with TIR in accordance with the present invention.
Figure 7B:
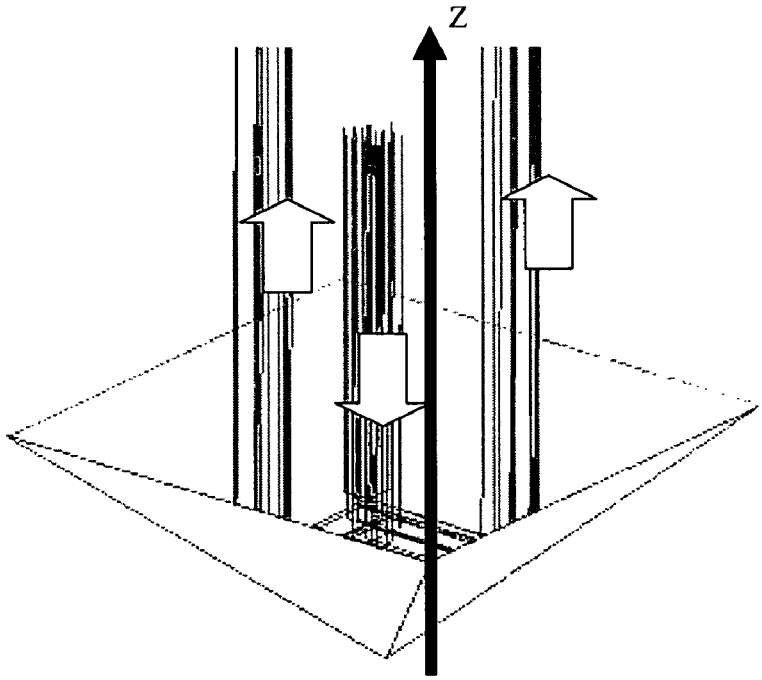

FIG. 7(*b*) shows another solution to avoid the manufacture difficulties of making small pitch prism structure which is a four sided pyramid type reflector. In this pyramid, the two side surfaces that face each other are in the perpendicular position. Therefore, the light coming parallel with the axis Z will be reflected back by TIR with no light loss.

Note that, for the pyramid type reflectors described above, the 90 degree head angle or so will make the incoming light and outgoing light parallel to each other which may not be the best design in terms of beam shaping, e.g. collimating or focusing. Therefore, the size of the cube reflector should be limited depending on the design specification target. On the other hand, the flatness and the shape of the reflector surfaces can also designed slightly different to meet the requirements.

Figure 8:
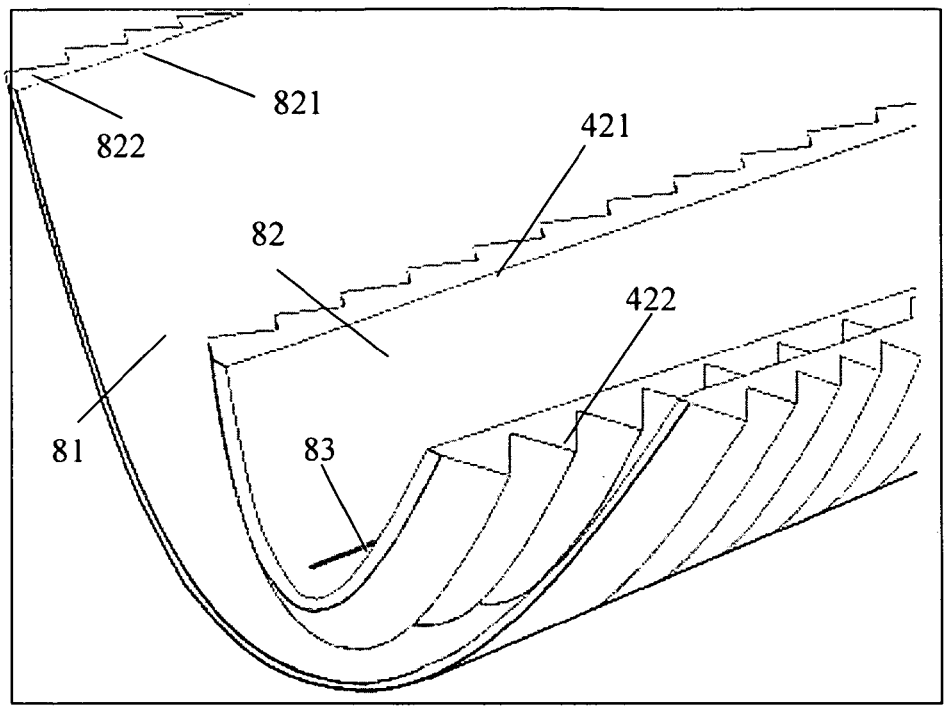
FIG. 8 illustrates double prism sheets reflector in accordance with a third embodiment of the present invention.

A third embodiment of the present invention relates to a coating-less reflector design as shown in FIG. 8. The reflector is similar to that shown in FIG. 4(*b*) with the exception that the outer reflector also is made up of a prism structured surface. The outer reflector can be coating-less but still have fairly high reflectance. Referring to FIG. 8, the outer reflector 81 has the similar surface structure with inner reflector 82. In FIG. 8, surface 821 is where the Fresnel reflection occurs with respect to light from the light source 83, and prism structured surface 822 is where one expects TIR taking place to reflect the light without loss. Again, by controlling the prism angle $\alpha$ and $\mu$, as discussed above with respect to FIG. 4(*c*), the light with different angular distribution can be obtained to meet the requirements.

Figure 9:
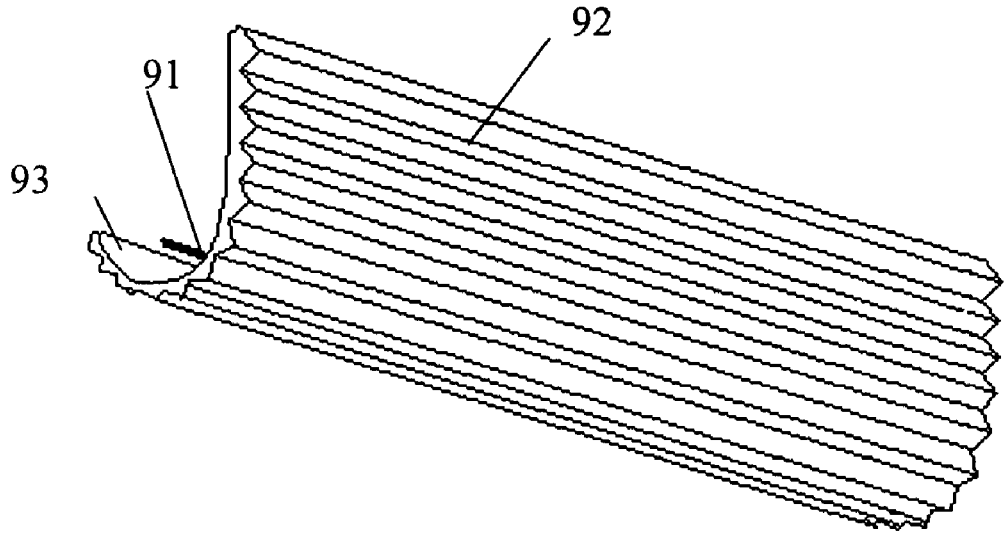
FIG. 9 illustrates elongate type prism reflector in accordance with a fourth embodiment of the present invention.

FIG. 9 shows another embodiment in which a linear light source 91is located at the focal point of a linear type reflector, 92 and 93, that has the cross section of parabolic shape. The surface 92 is flat surface where Fresnel reflection will occur. The surface 93 is prism type structured as discussed above, and that does not need high reflectance coating but still reflects the light with almost no loss due to around 90 degree top angle because TIR will occur again. The shape of the cross section of this reflector can be other shape like elliptical, circular, etc. The reflector can also be arranged as an array to form an illumination panel.

This type of coating-less reflector can also replace the outer reflector 41 shown in FIG. 4. Different combinations of the prism type reflectors can be considered to achieve more complex beam shaping results, among the means it also includes changing the direction of prism line which means the prism lines do not have to be parallel to each other. And the top angle as well as the pitch can vary along the axis of the linear reflector (not shown with graph).

Figure 10:
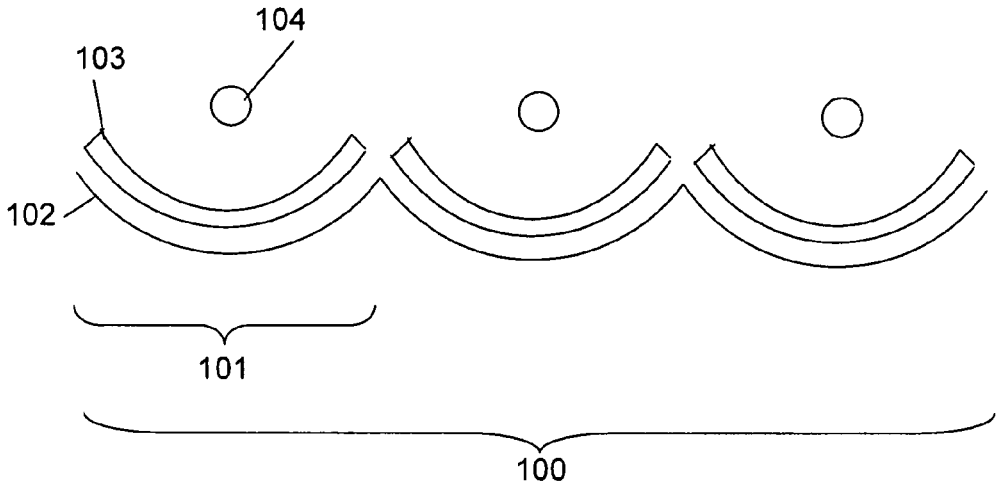
FIG. 10 illustrates the array of curved prism sheet reflector in accordance with an embodiment of the present invention.

A further aspect of this invention is shown in FIG. 10 in a cross sectional view. In this aspect an illumination system for a backlight 100 for a transmissive display is depicted that consists of a multitude of substantially identical units 101. The units 101 are substantially similar to the preferred embodiment in that they consist of a reflection surface 102, a prism sheet layer 103 and a light source 104.

FIG. 10 may show a cross section of a series of lenticular sections where the cross section shown is constant across the lenticular sections 101. The light source 104 may be a cold cathode fluorescent tube, optical fiber or other linear light source.

The diagram may also show each cross section of a two dimensionally symmetric (e.g. circle, square, hexagonal) or non symmetric illumination system, and the cross section 101 may depict for example a circularly symmetric element. The prism sheet layer 103 in this case maybe similar, for example, to the embodiment shown in FIG. 6. The light source in this case can be a point source such as LED or laser illuminating source.

The prism features on the sheets 103 may be different in different places in a single unit 101 in order to maintain uniformity of the backlight.

Additional diffuser, BEF and other films well known in the prior art may exist above this illumination system and are not depicted here.

The illumination system may also be used in other general lighting applications or in automotive lighting as described above.

In accordance with another aspect of the invention, the reflectors in each of the above-described embodiments can be used in a reciprocal manner as part of a light collection system so as to collect light from different directions. The collected light from different directions can be focused down to a small area with suitable angle.

For example, the embodiments described above may be used to collect sunlight which in turn is focused towards one or more solar cells. The one or more solar cells may be positioned in place of the light source as described above. Sunlight directed towards the system will be incident on the inner reflector. Light which is reflected by the inner surface of the inner reflector via Fresnel reflection is directed towards one or more solar cells located at the focal point of the inner reflector. Light which is refracted at the inner surface is incident on the prism structured surface and undergoes total internal reflection as described above. The totally internally reflected light is reflected back towards the inner surface and out towards the one or more solar cells located at the focal point of the inner reflector. Those embodiments having an outer reflector as described above will similarly reflect light which may pass through the inner reflector back through the inner reflector towards its focal point.

Although the light collection system has been described in the context of collecting sunlight for solar cells, the system may similarly be used in other systems having a type of photo-electric light receiving element (e.g., photodiode, phototransistor, etc.) relying on the collection of light. In such case, the light receiving element is represented, for example, by the reference labels 43, 83, 91, etc. in the figures in place of a light source.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

The invention claimed is:

1. An illumination system, comprising:

a light source; and a reflector having a focal point, the reflector including:

a first optical interface adjacent the light source which redirects light emitted from the light source and incident on the first optical interface via Fresnel reflection; and a second optical interface adjacent the first optical interface on a side opposite the light source, which reflects light passing through the first optical interface via total internal reflection back towards the first optical interface, wherein the reflector includes an optically transparent material which is curved in relation to the focal point with the light source located proximate the focal point, the optically transparent material having a flat surface on one side which forms a part of the first optical interface and redirects the light emitted from the light source via the Fresnel reflection toward the focal point, and a surface having a prism structure on an opposite side forming a part of the second optical interface to totally internally reflect the light passing through the first optical interface back towards the first optical interface and the focal point, and wherein the light source is a linear light source and the reflector runs parallel the linear light source, and the prism structure comprises parallel grooves which run in a direction orthogonal to an axis of the linear light source.

2. The system of claim 1, wherein the reflector is shaped to compress the light reflected via Fresnel reflection generally in a first plane in which the focal point lies, and the prism structure is arranged to compress the light reflected via total internal reflection generally in a second plane in which the focal point lies and orthogonal to the first plane.

3. The system of claim 1, wherein the reflector compresses the light reflected via Fresnel reflection generally in a first plane in which the focal point lies, and compresses light which passes through the second optical interface without being totally internally reflected in generally a second plane in which the focal point lies orthogonal to the first plane.

4. The system of claim 1, further comprising an outer reflector adjacent the reflector on a side opposite the light source which reflects light which was incident on the second optical interface but not totally internally reflected.

5. The system of claim 4, wherein the outer reflector is coated with a highly reflective material.

6. The system of claim 4, wherein the outer reflector comprises a third optical interface adjacent the reflector which redirects light passing through the reflector via Fresnel reflection; and a fourth optical interface adjacent the third optical interface on a side opposite the reflector, which reflects light passing through the third optical interface via total internal reflection back towards the third optical interface.

7. The system of claim 4, wherein the reflector and outer reflector are each elliptical, circular or parabolic in cross section and share a same focal point where the light source is located.

8. The system of claim 4, wherein the reflector and outer reflector are each elliptical, circular or parabolic in cross section and have different respective focal points proximate where the light source is located.

9. The system of claim 4, wherein the second optical interface diffracts the light which was not totally internally reflected towards an angle near normal to the outer reflector.

10. The system of claim 1, wherein the reflector is made only of optically transparent material.

11. The system of claim 10, wherein the material is at least one of a glass material or a plastic material.

12. The system according to claim 1, wherein the first optical interface and second optical interface each comprise an air/substrate interface.

13. The system according to claim 1, wherein the prism structure comprises grooves having at least one varying alignment, pitch, top angle or top angle orientation.

14. The system of claim 1, wherein the second optical interface comprises parallel grooves which run in a direction parallel to an axis of the linear light source.

15. A lighting system, comprising a plurality of illumination systems according to claim 1 each representing a unit arranged in an array.

16. A lighting system according to claim 15, wherein features of the respective reflectors of the units vary to maintain uniformity of the light provided by the lighting system.

17. A light collection system, comprising:

a photo-electric light receiving element; and a reflector having a focal point, the reflector including:

a first optical interface adjacent the light receiving element which redirects light incident on the first optical interface via Fresnel reflection towards the light receiving element; and a second optical interface adjacent the first optical interface on a side opposite the light receiving element, which reflects light passing through the first optical interface via total internal reflection back towards the first optical interface, wherein the reflector includes an optically transparent material which is curved in relation to the focal point with the light receiving element located proximate the focal point, the optically transparent material having a flat surface on one side which forms a part of the first optical interface and redirects the light incident on the first optical surface via the Fresnel reflection toward the focal point, and a surface having a prism structure on an opposite side forming a part of the second optical interface to totally internally reflect the light passing through the first optical interface back towards the first optical interface and the focal point, and wherein the light receiving element is a linear light receiving element and the reflector runs parallel the linear light receiving element, and the prism structure comprises parallel grooves which run in a direction orthogonal to an axis of the linear light receiving element.

18. The system of claim 17, wherein the reflector is shaped to compress the light reflected via Fresnel reflection generally in a first plane, including the focal point, and the prism structure is arranged to compress the light reflected via total internal reflection generally in a second plane including the focal point orthogonal to the first plane.

19. The system of claim 17, wherein the reflector compresses the light reflected via Fresnel reflection generally in a first plane including the focal point, and compresses light which passes through the second optical interface without being totally internally reflected in generally a second plane including the focal point orthogonal to the first plane.

* * * * *